US010031458B2

(12) United States Patent
Sivan et al.

(10) Patent No.: US 10,031,458 B2
(45) Date of Patent: Jul. 24, 2018

(54) REDUCE MERGING OF ADJACENT PRINTING DOTS ON A PHOTOSENSITIVE MEMBER

(71) Applicant: HEWLETT-PACKARD INDIGO B.V., Amstelveen (NL)

(72) Inventors: Yohanan Sivan, Raanana (IL); Ran Waidman, Rehovot (IL); Lior Katz, Raanana (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/514,607

(22) PCT Filed: Sep. 26, 2014

(86) PCT No.: PCT/EP2014/070680
§ 371 (c)(1),
(2) Date: Mar. 27, 2017

(87) PCT Pub. No.: WO2016/045751
PCT Pub. Date: Mar. 31, 2016

(65) Prior Publication Data

US 2017/0219978 A1 Aug. 3, 2017

(51) Int. Cl.
*G03G 15/00* (2006.01)
*G03G 15/16* (2006.01)

(52) U.S. Cl.
CPC ..... *G03G 15/5054* (2013.01); *G03G 15/1605* (2013.01)

(58) Field of Classification Search
CPC ..... G03G 15/5054; G03G 15/1605; G03G 15/502
See application file for complete search history.

(56) References Cited

U.S. PATENT DOCUMENTS

| | | | | |
|---|---|---|---|---|
| 5,081,528 | A * | 1/1992 | Hayashi | G03G 9/0819 358/3.17 |
| 5,493,323 | A | 2/1996 | Harrington | |
| 5,748,785 | A | 5/1998 | Mantell et al. | |
| 5,870,112 | A | 2/1999 | Kang et al. | |
| 6,359,640 | B1 | 3/2002 | Ravitz et al. | |

(Continued)

FOREIGN PATENT DOCUMENTS

| | | |
|---|---|---|
| EP | 0430451 | 6/1991 |
| EP | 1152299 | 11/2001 |

(Continued)

OTHER PUBLICATIONS

Goyal, P. et al., Electro-photographic Model Based Stochastic Clustered-dot Halftoning with Direct Binary Search, Nov. 30-Dec. 6, 2014.

*Primary Examiner* — Sandra Brase
(74) *Attorney, Agent, or Firm* — HP Inc. Patent Department

(57) ABSTRACT

A method includes forming a second set of printing dots on a photosensitive member by a printing dot applicator corresponding to image data of second portions of the image adjacent to first portions of the image. The second set of printing dots are formed on the photosensitive member after the first set of printing dots have been transferred from the photosensitive member. Thus, a merging of adjacent printing dots due to an electrical interaction there between on the photosensitive member is reduced.

20 Claims, 6 Drawing Sheets

(56) References Cited

U.S. PATENT DOCUMENTS

| | | | | |
|---|---|---|---|---|
| 6,582,056 | B2 | 6/2003 | Alfaro | |
| 7,136,189 | B2 | 11/2006 | Sharma et al. | |
| 7,342,685 | B2 | 3/2008 | Minnebo et al. | |
| 2006/0238782 | A1 | 10/2006 | Kim | |
| 2012/0093544 | A1* | 4/2012 | Sandler ..... | G03G 15/10 399/297 |

FOREIGN PATENT DOCUMENTS

| | | | |
|---|---|---|---|
| JP | 09-236939 | * | 9/1997 |
| JP | H09236939 | | 9/1997 |
| JP | 2006018313 | | 1/2006 |

* cited by examiner

REDUCE MERGING OF ADJACENT PRINTING DOTS ON A PHOTOSENSITIVE MEMBER

CROSS-REFERENCE TO RELATED APPLICATION

This application is a U.S. National Stage Application of and claims priority to International Patent Application No. PCT/EP2014/070680, filed on Sep. 26, 2014, and entitled "REDUCE MERGING OF ADJACENT PRINTING DOTS ON A PHOTOSENSITIVE MEMBER," which is hereby incorporated by reference in its entirety.

BACKGROUND

Printing apparatuses include printing dot applicators to form printing dots on photosensitive members. The photosensitive members transfer the printing dots therefrom to subsequently form images on media.

BRIEF DESCRIPTIONS OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Figure 1:
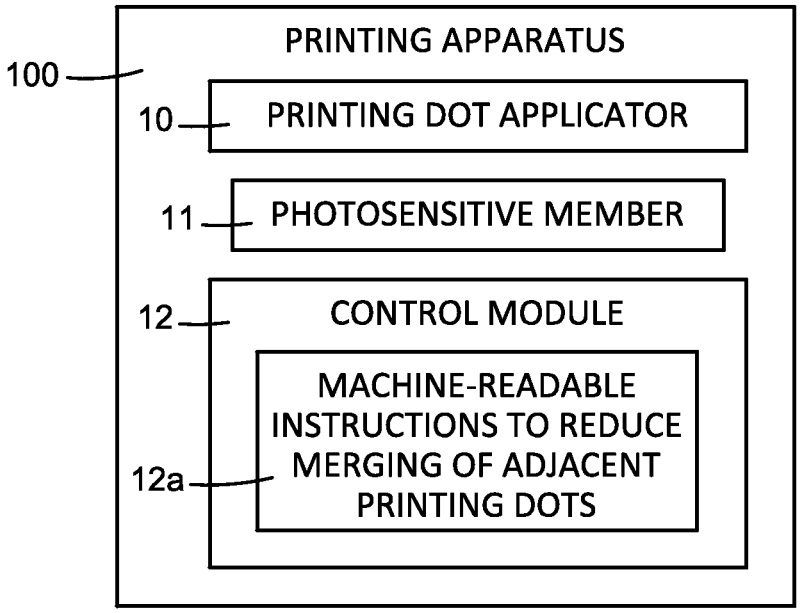
FIG. 1 is a block diagram illustrating a printing apparatus according to an example.

A printing apparatus includes a printing dot applicator to form printing dots on a photosensitive member. A printing dot applicator is a device that applies printing dots such as a marking agent to an object such as a photosensitive member. The photosensitive member transfers the printing dots therefrom to, subsequently, form printed images on media. For example, in indirect printing, the photosensitive member transfers the printing dots to an intermediate transfer member such as an intermediate transfer blanket. Thereafter, the intermediate transfer member transfers the printing dots to the media. In direct printing, the photosensitive member transfers the printing dots directly to the media, rather than through an intermediate transfer member. Periodically, however, adjacent printing dots formed on the photosensitive member may undesirably merge with each other.

For example, adjacent printing dots formed on the photosensitive member may electrically interact with each other. Such electrical interaction may cause adjacent printing dots thereon to attract to each other resulting in dot gain (e.g., an increase in a size of a respective printing dot). That is, adjacent printing dots expand towards each other and merge thereby eliminating a space there between. Thus, a printed image formed on the media by the transfer of the merged printing dots may be blurry. Additionally, an initial distance between adjacent printing dots placed next to each other on the photosensitive member may not be minimized due to merging. Thus, an amount of halftone levels able to be produced by such printing dots to form the printed image which electrically interact with each other may be further limited.

In examples, a method of forming a printed image includes forming a first set of printing dots on a photosensitive member by a printing dot applicator corresponding to image data of first portions of an image on a photosensitive member and transferring the first set of printing dots from the photosensitive member to at least one of a media or an intermediate transfer member. The method also includes forming a second set of printing dots on the photosensitive member by the printing dot applicator corresponding to the image data of second portions of the image adjacent to the first portions after the first set of printing dots have been transferred from the photosensitive member to reduce merging of adjacent printing dots on the photosensitive member due to an electrical interaction there between.

The method also includes transferring the second set of printing dots from the photosensitive member to the at least one of the media or the intermediate transfer member. Thus, the reduction of the merging of adjacent printing dots on the photosensitive member enables a more defined and less blurry printed image to be formed on the media. Further, an increase in the amount of halftone levels may be produced to form the printed image due to the ability to place printing dots closer to each other on the photosensitive member.

FIG. 1 is a block diagram illustrating a printing apparatus according to an example. Referring to FIG. 1, in some examples, a printing apparatus 100 includes a printing dot applicator 10, a photosensitive member 11, and a control module 12. The printing dot applicator 10 forms a first set of printing dots by a printing dot applicator 10 corresponding to image data of first portions of an image on the photosensitive member 11. The printing dot applicator 10 also subsequently forms a second set of printing dots on the photosensitive member 11 by the printing dot applicator 10 corresponding to the image data of second portions of the image adjacent to the first portions. In some examples, the printing dot applicator 10 may include a toner cartridge, a binary ink developer, and the like.

Referring to FIG. 1, the photosensitive member 11 transfers the first set of printing dots from the photosensitive member 11 to at least one of a media (e.g., direct printing) or an intermediate transfer member (e.g., indirect printing). The photosensitive member 11 also subsequently transfers the second set of printing dots from the photosensitive member 11 to the at least one of the media or the intermediate transfer member. The printing dot applicator 10 forms the second set of printing dots on the photosensitive member 11 based on the control module 12 after the first set of printing dots have been transferred from the photosensitive member 11 to reduce merging of adjacent printing dots due to an electrical interaction there between on the photosensitive member 11. That is, the control module 12 may communicate with the printing dot applicator 10 and the photosensitive member 11 to direct the sequencing of forming and transferring respective sets of printing dots. In some examples, the control module 12 may include machine-readable instructions 12*a* to reduce merging of adjacent printing dots due to an electrical interaction there between on the photosensitive member 11.

In some examples, the control module 12 may be implemented in hardware, software including firmware, or combinations thereof. For example, the firmware may be stored in memory and executed by a suitable instruction-execution system. If implemented in hardware, as in an alternative example, the control module 12 may be implemented with any or a combination of technologies which are well known in the art (for example, discrete-logic circuits, application-specific integrated circuits (ASICs), programmable-gate arrays (PGAs), field-programmable gate arrays (FPGAs)), and/or other later developed technologies. In some examples, the control module 12 may be implemented in a combination of software and data executed and stored under the control of a computing device.

In some examples, the printing apparatus 100 may include a plurality of photosensitive members 11 and a plurality of printing dot applicators 10. Each one of the printing dot applicators 10 may apply printing dots of a respective color to a corresponding photosensitive member 11. For example, the plurality of printing dot applicators 10 include a magenta printing dot applicator to apply magenta printing dots to a respective photosensitive member to receive the magenta printing dots, a cyan printing dot applicator to apply cyan printing dots to a respective photosensitive member to receive the cyan printing dots, a yellow printing dot applicator to apply yellow printing dots to a respective photosensitive member to receive the yellow printing dots, and a black printing dot applicator to apply black printing dots to a respective photosensitive member to receive the black printing dots.

Figure 2A:
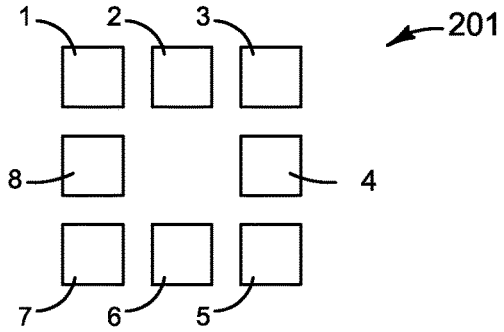
FIG. 2A is a schematic view illustrating a digital image in communication with the printing apparatus of FIG. 1 according to an example.
Figure 2B:
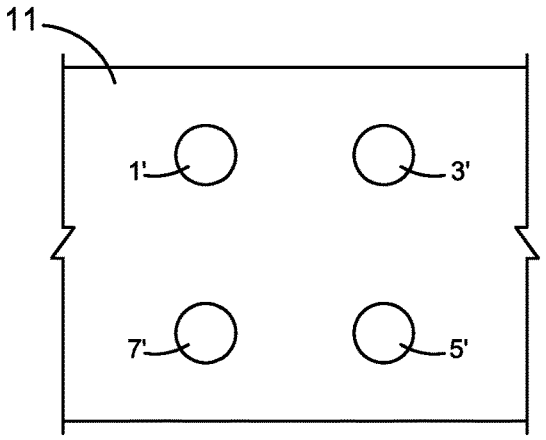
FIG. 2B is a schematic view illustrating a first set of printing dots formed on a photosensitive member by the printing apparatus of FIG. 1 corresponding to the digital image of FIG. 2A according to an example.
Figure 2C:
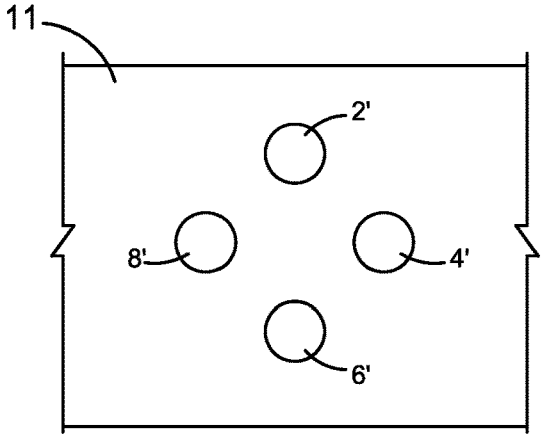
FIG. 2C is a schematic view illustrating a second set of printing dots formed on a photosensitive member by the printing apparatus of FIG. 1 corresponding to the digital image of FIG. 2A according to an example.
Figure 2D:
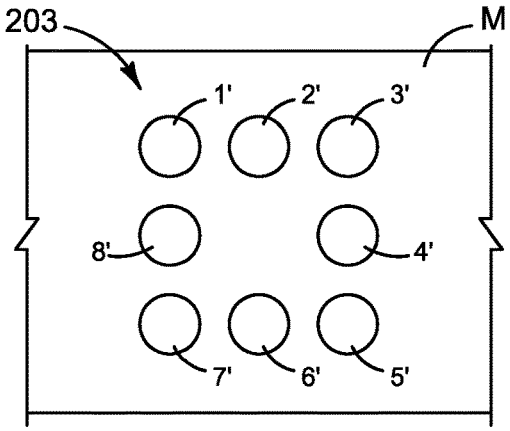
FIG. 2D is a schematic view illustrating a printed image formed on a media by the printing apparatus of FIG. 1 corresponding to the digital image of FIG. 2A according to an example.

FIG. 2A is a schematic view illustrating a digital image in communication with the printing apparatus of FIG. 1 according to an example. FIG. 2B is a schematic view illustrating a first set of printing dots formed on a photosensitive member corresponding to the digital image of FIG. 2A by the printing apparatus of FIG. 1 according to an example. FIG. 2C is a schematic view illustrating a second set of printing dots formed on a photosensitive member dots corresponding to the digital image of FIG. 2A by the printing apparatus of FIG. 1 according to an example. FIG. 2D is a schematic view illustrating a printed image formed on a media by the printing apparatus of FIG. 1 corresponding to the digital image of FIG. 2A according to an example. Referring to FIG. 2A, a digital image 201 corresponding to eight portions 1, 2, 3, 4, 5, 6, 7, and 8 are arranged in a square pattern. In such an arrangement, portion 1 is adjacent to portion 2 and portion 8. Portion 2 is adjacent to portion 1 and portion 3, and so on.

Referring to FIG. 2B, a first set of printing dots 1', 3', 5', and 7' corresponding to the first portions 1, 3, 5, and 7 of the digital image 201 is formed on the photosensitive member 11 by the printing dot applicator 10 of the printing apparatus 100 as a first separation. That is, the first set of printing dots 1', 3', 5', and 7' is subsequently transferred therefrom. Separations are respective layers decomposed from an original image and printed individually with respect to each other to form a printed image corresponding to the original image. Referring to FIG. 2C, a second set of printing dots 2', 4', 6', and 8' corresponding to second portions 2, 4, 6, and 8 of the digital image 201 is formed on the photosensitive member 11 by the printing dot applicator 10 of the printing apparatus 100 as a second separation which is subsequently transferred therefrom and ultimately to the media M. That is, the second set of printing dots 2', 4', 6', and 8' is placed adjacent to the previously placed first set of printing dots 1', 3', 5', and 7' on the media M. Referring to FIG. 2D, a printed image 203 is formed on the media M corresponding to the digital image 201 through a plurality of separations performed by the printing apparatus 100 such that different separations included adjacent portions of the digital image 201.

Figure 3:
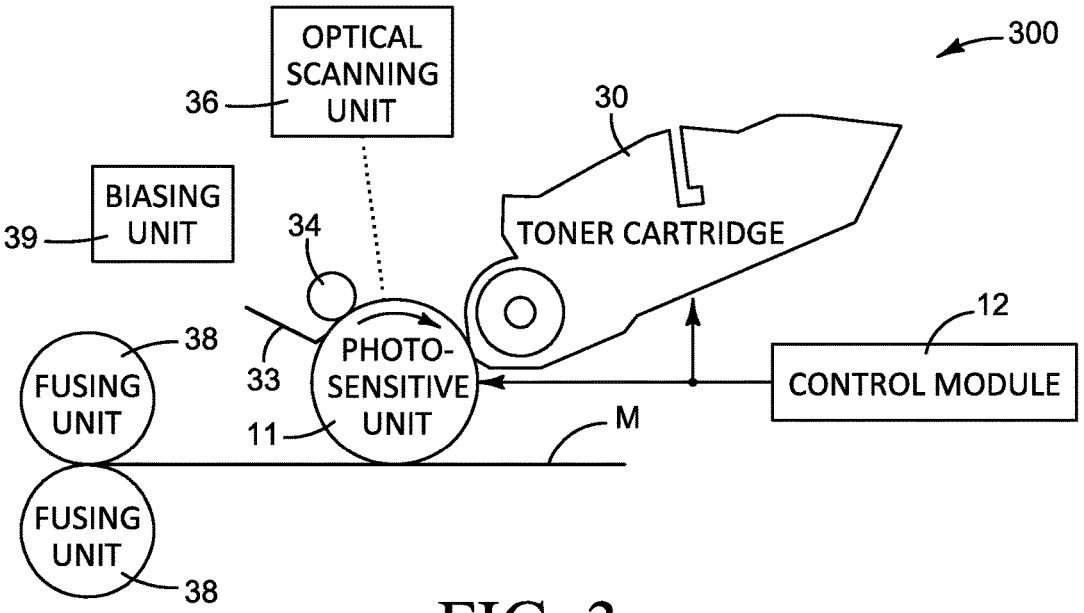
FIG. 3 is a schematic view illustrating a printing apparatus such as an electrophotographic imaging forming apparatus according to an example.

FIG. 3 is a schematic view illustrating a printing apparatus such as an electrophotographic imaging forming apparatus according to an example. Referring to FIG. 3, in some examples, a printing apparatus 300 is an electrophotographic imaging forming apparatus such as a laser printer. The printing apparatus 300 may include a printing dot applicator 10 (such as a toner cartridge 30), a photosensitive member 11, a control module 12, a charging unit 34, an optical scanning unit 36, a biasing unit 39, a fusing unit 38, and a cleaning unit 33. The charging unit 34 such as a charging roller charges the photosensitive member 11. The optical scanning unit 36 such as a laser scans a charged surface of the photosensitive member 11 to change the charge of portions thereto corresponding to image data to form a latent image thereof. In some examples, the photosensitive member 11 may include a photo imaging member, and the like.

Referring to FIG. 3, in some examples, a printing dot applicator 10 (FIG. 1) such as a toner cartridge 30 applies the toner on the latent image of the photosensitive member 11. The biasing unit 39 may establishes an electrostatic potential difference to allow the toner to be applied from the toner cartridge 30 to the latent image of the photosensitive member 11. The photosensitive member 11 rotates to receive the latent image and toner. The control module 12 controls the toner cartridge 30 to apply the toner to the photosensitive member 11 in a form of a plurality of sets of printing dots such that respective sets of printing dots corresponding to adjacent portions of an image are provided on the photosensitive member 11 at different times and as different separations. The photosensitive member 11, for example, transfers the respective sets of printing dots to the media M to form the printed image in direct printing (or to an intermediate transfer member and subsequently to the media M in indirect printing). The cleaning unit 33 removes residue toner remaining on the photosensitive member 11 after the transfer of the toner corresponding to the latent image from the photosensitive member 11.

Referring to FIG. 3, in some examples, the control module 12 controls the toner cartridge 30 to form the first set of printing dots on the photosensitive member 11 corresponding to image data of first portions of an image. The control module 12 also controls the toner cartridge 30 to subsequently form a second set of printing dots on the photosensitive member 11 corresponding to the image data of second portions of the image adjacent to the first portions. The control module 12 also controls the photosensitive member 11 to transfer the first set of printing dots from the photosensitive member 11 to the media M (or to an intermediate transfer member in indirect printing). The control module 12 also controls the photosensitive member 11 to subsequently transfer the second set of printing dots from the photosensitive member 11 to the media to form the printed image thereon (or to the intermediate transfer member in indirect printing).

Figure 4:
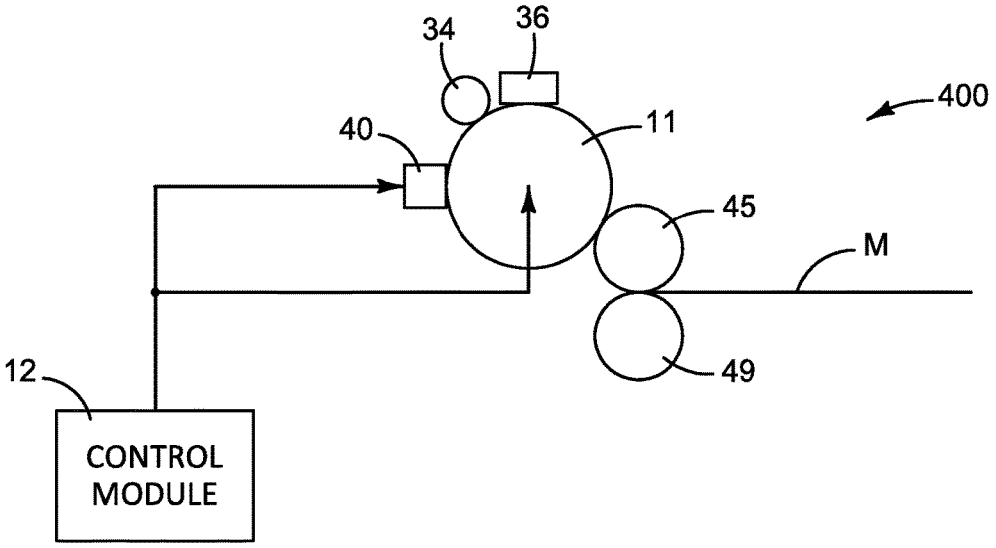
FIG. 4 is a schematic view illustrating a printing apparatus such as a liquid electrophotography printing apparatus according to an example.

Thus, the toner cartridge 30 forms the second set of printing dots on the photosensitive member 11 based on the control module 12 after the first set of printing dots have been transferred from the photosensitive member 11 to reduce merging of adjacent printing dots member due to an electrical interaction there between on the photosensitive member 11. For example, the control module 12 controls the toner cartridge 30 to form the second set of printing dots on the photosensitive member 11 after the first set of printing dots have been transferred from the photosensitive member 11 to reduce merging of adjacent printing dots due to an electrical interaction there between on the photosensitive member 11. The first and second sets of printing dots transferred to the media M form the printed image thereon FIG. 4 is a schematic view of a printing apparatus such as a liquid electrophotography printing apparatus according to an example. Referring to FIG. 4, in some examples, a printing apparatus 400 such as a liquid electrophotography printing apparatus (LEP) may include a printing dot applicator 10 (such a binary ink developer (BID 40)), a photosensitive member 11, a control module 12, a charging unit 34, an optical scanning unit 36, an intermediate transfer member (ITM) 45, and an impression member 49. The charging unit 34 charges an outer surface of the photosensitive member 11. The optical scanning unit 36 discharges portions of the outer surface of the photosensitive member 11 that correspond to features of the image to form a latent image thereon.

Referring to FIG. 4, the BID 40 applies printing dots in a form of liquid toner such as, ElectroInk, trademarked by Hewlett-Packard Company to the latent image to form an image on the outer surface of the photosensitive member 11. The photosensitive member 11 rotates to receive the latent image and toner. For example, the control module 12 controls the BID 40 to apply the liquid toner to the photosensitive member 11 in a form of a plurality of sets of printing dots. The respective sets of printing dots corresponding to adjacent portions of an image are provided on the photosensitive member 11 at different times and as different separations. The photosensitive member 11 transfers the image to the ITM 45. The ITM 45 transfers the image to the media M to form a printed image. During the transfer from the ITM 45 to the media M, the media M is pinched between the ITM 45 and an impression member 49.

Referring to FIG. 4, in some examples, the control module 12 may control the BID 40 to form the first set of printing dots on the photosensitive member 11 by a printing dot applicator corresponding to image data of first portions of an image. The control module 12 may also control the BID 40 to subsequently form a second set of printing dots on the photosensitive member 11 corresponding to the image data of second portions of the image. The second portions of the image are adjacent to the first portions of the image. The control module 12 also controls the photosensitive member 11 to transfer the first set of printing dots from the photosensitive member 11 to the intermediate transfer member 45. The second set of printing dots is formed on the photosensitive member 11 after the transferring of the first set of printing dots thereon. The control module 12 also controls the photosensitive member 11 to subsequently transfer the second set of printing dots from the photosensitive member 11 to the intermediate transfer member 45.

Thus, the BID 40 forms the second set of printing dots on the photosensitive member 11 based on the control module 12 after the first set of printing dots have been transferred from the photosensitive member 11 to reduce merging of adjacent printing dots member due to an electrical interaction there between on the photosensitive member 11. For example, the control module 12 controls the BID 40 to form the second set of printing dots on the photosensitive member 11 after the first set of printing dots have been transferred from the photosensitive member 11 to reduce merging of adjacent printing dots due to an electrical interaction there between on the photosensitive member 11.

In some examples, the control module 12 may be implemented in hardware, software including firmware, or combinations thereof. For example, the firmware may be stored in memory and executed by a suitable instruction-execution system. If implemented in hardware, as in an alternative example, the control module 12 may be implemented with any or a combination of technologies which are well known in the art (for example, discrete-logic circuits, application-specific integrated circuits (ASICs), programmable-gate arrays (PGAs), field-programmable gate arrays (FPGAs)), and/or other later developed technologies. In some examples, the control module 12 may be implemented in a combination of software and data executed and stored under the control of a computing device.

Figure 5:
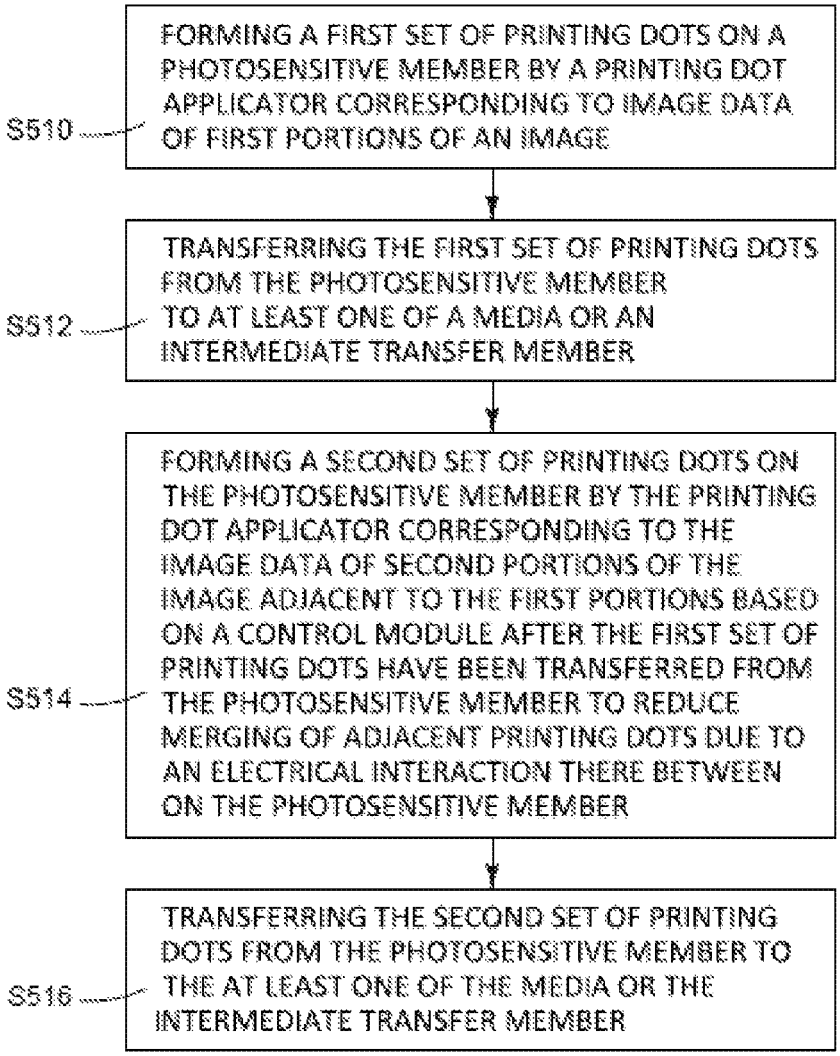
FIG. 5 is a flowchart illustrating forming a printed image by a printing apparatus according to an example.

FIG. 5 is a flowchart illustrating a method of forming a printed image by a printing apparatus according to an example. Referring to FIG. 5, in block S510, a first set of printing dots corresponding to image data of first portions of an image is formed on a photosensitive member by a printing dot applicator. In block S512, the first set of printing dots is transferred from the photosensitive member to at least one of a media or an intermediate transfer member. In block S514, a second set of printing dots is formed on the photosensitive member by the printing dot applicator corresponding to the image data of second portions of the image adjacent to the first portions based on a control module after the first set of printing dots have been transferred from the photosensitive member to reduce merging of adjacent printing dots on the photosensitive member due to an electrical interaction there between. In some examples, the first set of printing dots and the second set of printing dots are a same color.

In block S516, the second set of printing dots is transferred from the photosensitive member to the at least one of the media or the intermediate transfer member. In some examples, the photosensitive member transfers the first set of printing dots and the second set of printing dots to the intermediate transfer member. Additionally, the method also includes transferring the first set of printing dots and the second set of printing dots from the intermediate transfer member to the media to form a printed image. In some examples, the first set of printing dots and the second set of printing dots include toner.

Figure 6:
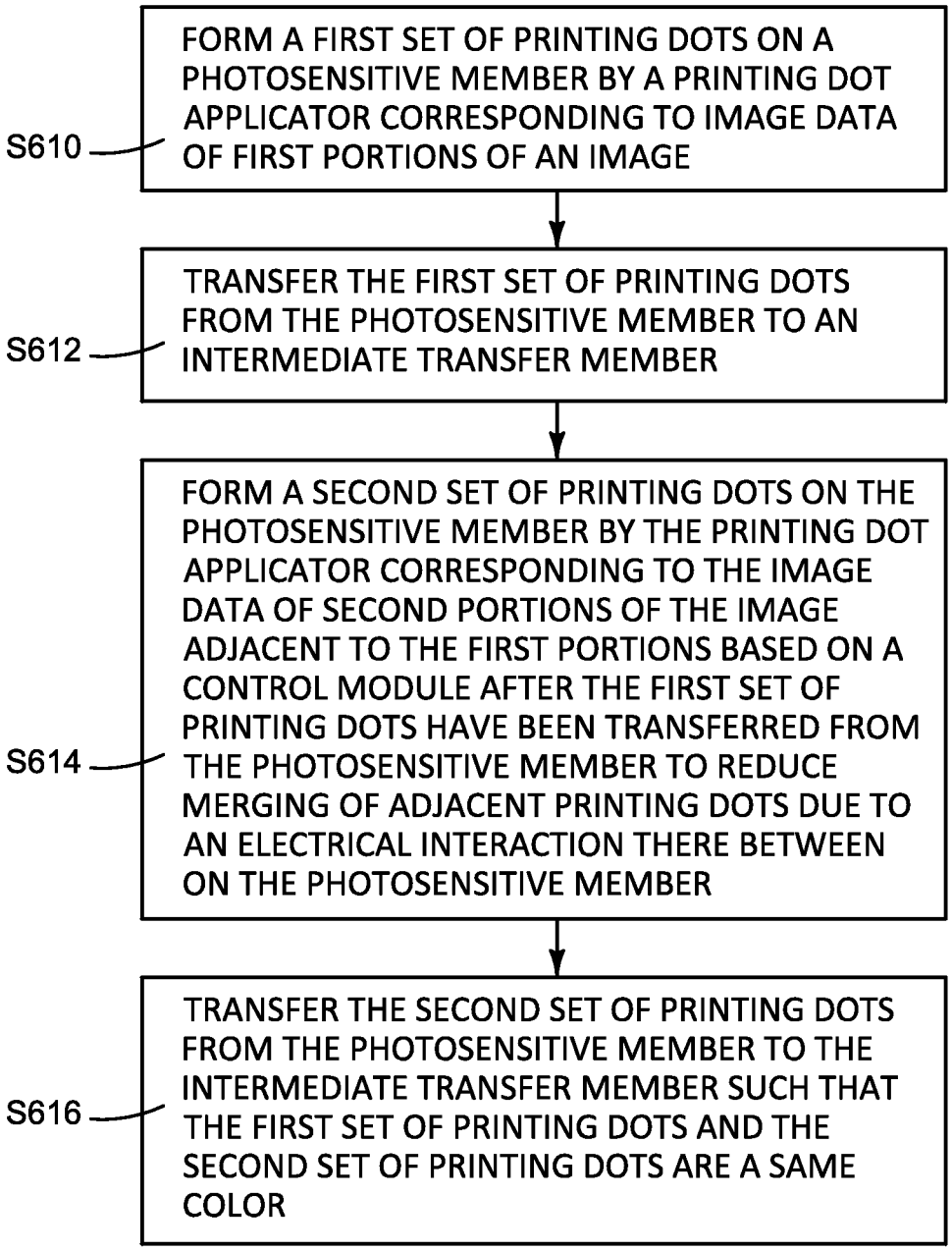
FIG. 6 is a flowchart illustrating forming a printed image by a printing apparatus according to an example.

FIG. 6 is a flowchart illustrating a method of forming a printed image in a printing apparatus according to an example. Referring to FIG. 6, in block S610, a first set of printing dots is formed on a photosensitive member by a printing dot applicator corresponding to image data of first portions of an image. In block S612, the first set of printing dots is transferred from the photosensitive member to an intermediate transfer member. In block S614, a second set of printing dots is formed on the photosensitive member by the printing dot applicator corresponding to the image data of second portions of the image adjacent to the first portions based on a control module after the first set of printing dots have been transferred from the photosensitive member to reduce merging of adjacent printing dots on the photosensitive member due to an electrical interaction there between. In block S616, the second set of printing dots is transferred from the photosensitive member to the intermediate transfer member such that the first set of printing dots and the second set of printing dots are a same color. The method may also include transferring a firsts set of printing dots and a second set of printing dots to a media to form a printed image.

Figure 7:
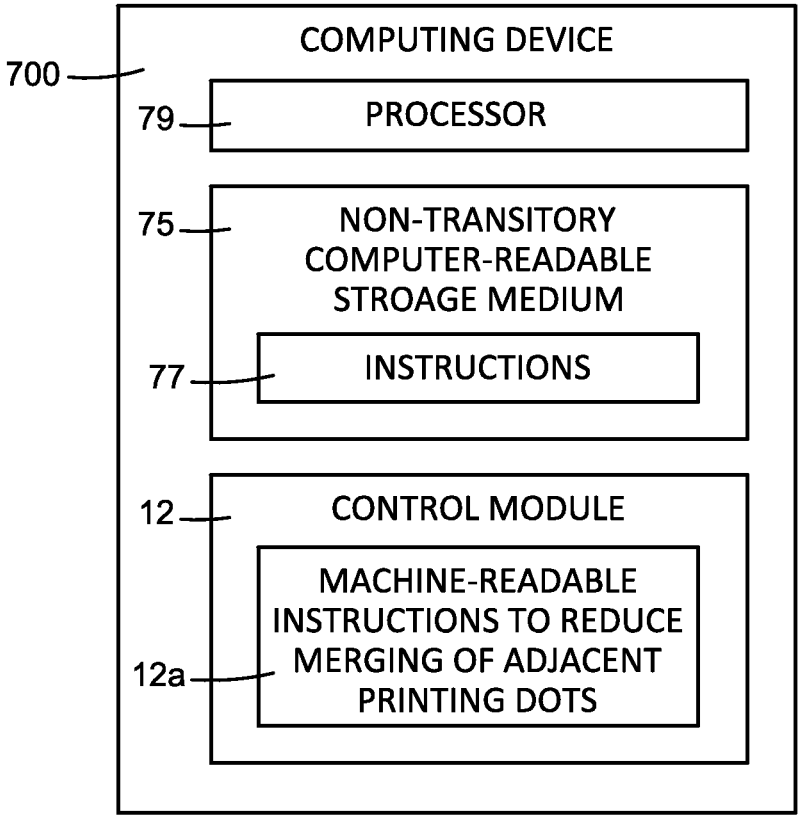
FIG. 7 is a block diagram illustrating a computing device including a processor and a non-transitory, computer-readable storage medium to store instructions to form a printed image according to an example.

FIG. 7 is a block diagram illustrating a computing device including a processor and a non-transitory, computer-readable storage medium to store instructions to form a printed image according to an example. Referring to FIG. 7, in some examples, the non-transitory, computer-readable storage medium 75 may be included in a computing device 700 such as a printing apparatus to form a printed image. In some examples, the non-transitory, computer-readable storage medium 75 may be implemented in whole or in part as instructions 77 such as computer-implemented instructions stored in the computing device locally or remotely, for example, in a server or a host computing device.

Referring to FIG. 7, in some examples, the non-transitory, computer-readable storage medium 75 may correspond to a storage device that stores instructions 77, such as computer-implemented instructions and/or programming code, and the like. For example, the non-transitory, computer-readable storage medium 75 may include a non-volatile memory, a volatile memory, and/or a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM).

Referring to FIG. 7, examples of storage devices include, but are not limited to, hard disk drives, compact disc drives, digital versatile disc drives, optical drives, and flash memory devices. In some examples, the non-transitory, computer-readable storage medium 75 may even be paper or another suitable medium upon which the instructions 77 are printed, as the instructions 77 can be electronically captured, via, for instance, optical scanning of the paper or other medium, then compiled, interpreted or otherwise processed in a single manner, if necessary, and then stored therein. A processor 79 generally retrieves and executes the instructions 77 stored in the non-transitory, computer-readable storage medium 75, for example, to operate a computing device 700 such a printing apparatus to form a printed image in accordance with an example. In an example, the non-transitory, computer-readable storage medium 75 can be accessed by the processor 79.

It is to be understood that the flowcharts of FIGS. 5 and 6 illustrate architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowcharts of FIGS. 5 and 6 illustrate a specific order of execution, the order of execution may differ from that which is depicted. For example, the order of execution of two or more blocks may be rearranged relative to the order illustrated. Also, two or more blocks illustrated in succession in FIGS. 5 and 6 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A printing apparatus, comprising:

a photosensitive member;

a printing dot applicator to form a first set of printing dots on the photosensitive member corresponding to image data of first portions of an image, and to subsequently form a second set of printing dots on the photosensitive member corresponding to the image data of second portions of the image adjacent to the first portions; and the photosensitive member to transfer the first set of printing dots from the photosensitive member to at least one of a media or an intermediate transfer member, and to subsequently transfer the second set of printing dots from the photosensitive member to the at least one of the media or the intermediate transfer member; and a control module including machine-readable instructions to communicate with the printing dot applicator to form the second set of printing dots on the photosensitive member after the first set of printing dots have been transferred from the photosensitive member to reduce merging of adjacent printing dots due to an electrical interaction there between on the photosensitive member.

2. The printing apparatus of claim 1, wherein the printing dot applicator comprises:

a toner cartridge to apply toner to the photosensitive member in a form of the first set of printing dots and the second set of printing dots.

3. The printing apparatus of claim 1, wherein the printing dot applicator comprises:

a binary ink developer to apply toner to the photosensitive member in a form of the first set of printing dots and the second set of printing dots.

4. The printing apparatus of claim 1, further comprising:

the intermediate transfer member to receive the first set of printing dots and the second set of printing dots from the photosensitive member.

5. The printing apparatus of claim 4, wherein the intermediate transfer member is to transfer the first set of printing dots and the second set of printing dots to the media.

6. The printing apparatus of claim 1, wherein the photosensitive member includes a latent image to attract respective printing dots from the printing dot applicator.

7. The printing apparatus of claim 1, wherein the photosensitive member comprises:

a photo imaging member.

8. The printing apparatus of claim 1, further comprising:

a plurality of photosensitive members; and a plurality of printing dot applicators, each one of the printing dot applicators to apply printing dots of a respective color to a corresponding photosensitive member.

9. The printing apparatus of claim 8, wherein the plurality of printing dot applicators comprise:

a magenta printing dot applicator to apply magenta printing dots to a respective photosensitive member to receive the magenta printing dots;

a cyan printing dot applicator to apply cyan printing dots to a respective photosensitive member to receive the cyan printing dots;

a yellow printing dot applicator to apply yellow printing dots to a respective photosensitive member to receive the yellow printing dots; and a black printing dot applicator to apply black printing dots to a respective photosensitive member to receive the black printing dots.

10. The printing apparatus of claim 1, wherein none of the first set of printing dots and the second set of printing dots overlap when transferred from the photosensitive member.

11. The printing apparatus of claim 1, wherein the printing dot applicator comprises a single toner cartridge to apply toner to the photosensitive member to form the first set of printing dots and the second set of printing dots so that both the first and second sets of printing dots have a same color.

12. The printing apparatus of claim 1, wherein the printing dot applicator comprises a single binary ink developer to apply toner to the photosensitive member to form the first set of printing dots and the second set of printing dots so that both the first and second sets of printing dots have a same color.

13. A method of forming a printed image by a printing apparatus, the method comprising:

forming a first set of printing dots on a photosensitive member by a printing dot applicator corresponding to image data of first portions of an image on a photosensitive member;

transferring the first set of printing dots from the photosensitive member to at least one of a media or an intermediate transfer member;

forming a second set of printing dots on the photosensitive member, by the same printing dot applicator, corresponding to the image data of second portions of the image adjacent to the first portions based on a control module after the first set of printing dots have been transferred from the photosensitive member to reduce merging of adjacent printing dots due to an electrical interaction there between on the photosensitive member, wherein the first and second sets of printing dots are formed by the same printing dot applicator from a common material so as to have exactly a same color; and transferring the second set of printing dots from the photosensitive member to the at least one of the media or the intermediate transfer member.

14. The method of claim 13, wherein the photosensitive member transfers the first set of printing dots and the second set of printing dots to the intermediate transfer member.

15. The method of claim 13, further comprising:

transferring the first set of printing dots and the second set of printing dots from the intermediate transfer member to the media to form the printed image.

16. The method of claim 13, wherein the first set of printing dots and the second set of printing dots comprise toner.

17. A non-transitory computer-readable storage medium having computer executable instructions stored thereon to form a printed image, the instructions are executable by a processor to:

form a first set of printing dots on a photosensitive member by a printing dot applicator corresponding to image data of first portions of an image;

transfer the first set of printing dots from the photosensitive member to an intermediate transfer member;

form a second set of printing dots on the photosensitive member by the printing dot applicator corresponding to the image data of second portions of the image adjacent to the first portions based on a control module after the first set of printing dots have been transferred from the photosensitive member to reduce merging of adjacent printing dots due to an electrical interaction there between on the photosensitive member; and transfer the second set of printing dots from the photosensitive member to the intermediate transfer member such that none of the first set of printing dots and the second set of printing dots overlap on the intermediate transfer member.

18. The storage medium of claim 17, wherein the first and second sets of printing dots are formed by the processor operating a single printing dot applicator applying a same material to form both the first and second sets of printing dots so that both the first and second sets of printing dots have a same color.

19. The storage medium of claim 17, wherein the printing dot applicator comprises a single toner cartridge to apply toner to the photosensitive member to form the first set of printing dots and the second set of printing dots.

20. The storage medium of claim 17, wherein the printing dot applicator comprises a single binary ink developer to apply toner to the photosensitive member to form the first set of printing dots and the second set of printing dots.

* * * * *